US005915327A

United States Patent [19]

Elvestad

[11] Patent Number: 5,915,327

[45] Date of Patent: Jun. 29, 1999

[54] COLLAPSIBLE CANOE SKIN

[76] Inventor: Alf J. Elvestad, P.O. Box 700, Enfield, N.H. 03748

[21] Appl. No.: 08/847,452

[22] Filed: Apr. 24, 1997

[51] Int. Cl.[6] ..... B63B 7/06; B63B 7/08

[52] U.S. Cl. ..... 114/347; 114/354

[58] Field of Search ..... 114/347, 354

[56] References Cited

U.S. PATENT DOCUMENTS

| | | | |
|---|---|---|---|
| 2,415,495 | 2/1947 | Humphreys | 114/354 |
| 3,049,731 | 8/1962 | Ertl et al. | 9/2 |
| 4,290,157 | 9/1981 | Jensen, Jr. | 9/2 C |
| 5,615,634 | 4/1997 | Gonda | 114/354 |

OTHER PUBLICATIONS

"Pakboats", ScanSport Inc., Feb. 1995.

Bob Foote, "Portable High Performance: The New Ally 15 Pak Canoe", River Runner Magazine, Mar.–Apr. 195.

*Primary Examiner*—Sherman Basinger
*Attorney, Agent, or Firm*—Jeffrey E. Semprebon; Michael J. Weins

[57] ABSTRACT

A composite skin tar a collapsible canoe. The skin covers a frame which includes a pair of gunwales, ribs, and stringers. The skin has a pair of polymer-coated gunwale sleeves which slidably engage the gunwales, a pair of polymer-coated side panels, each attached to one of the gunwale sleeves, and a polymer-coated bottom panel attached to the side panels. In one embodiment of the skin, the side panels are attached to the bottom panel with a heat sealed seam. One aspect of the invention is the gunwale sleeves, each of which has a fabric layer, providing a surface with reduced friction to allow the gunwales to be inserted or removed without binding. Another aspect of the invention is the bottom panel, which is constructed from a bottom fabric substrate having an uncoated inner surface, to which is attached a foam pad. Preferably, longitudinal rub strips of a polymer film are bonded to the coated outer surface of the bottom panel. Another aspect of the invention is a pair of side flotation compartments, each having a flotation chamber sleeve which is configured to slidably accept a plurality of individually removable flotation chambers. The flotation chambers are of a polymer film, allowing them to readily be repaired in the field.

20 Claims, 6 Drawing Sheets

COLLAPSIBLE CANOE SKIN

FIELD OF THE INVENTION

The present invention relates to a collapsible canoe having a frame and a skin, and more particularly to the skin for such a collapsible canoe.

BACKGROUND OF THE INVENTION

Collapsible canoes have been available for many years. One early canoe which was well suited for packing is described in U.S. Pat. No. 4,290,157. More recently, a collapsible canoe has been developed and marketed by ScanSport, Inc. An alternative collapsible canoe is described in U.S. Pat. No. 5,615,634.

FIGS. 1 through 4 illustrate a prior art collapsible canoe 10 such as the canoe marketed by ScanSport, Inc. The collapsible canoe 10 has a frame 12 which supports a skin 14. The skin 14 encloses the frame 12 and, when tightly engaged thereover, enhances the rigidity of the frame 12.

FIG. 1 is an isometric view of the collapsible canoe 10 where a portion of the skin 14 has been removed to better illustrate the underlying structure. The frame 12 is has a pair of gunwales 16, to which a series of ribs 18 are clipably attached. A gunwale-engaging clip 20 (shown in FIG. 3) is provided on each end of each of the ribs 18, and is configured to snap onto the gunwale 16. A series of stringer-engaging clips 22 (illustrated in FIG. 4) are fixably attached to each of the ribs 18 to stabilize a series of longitudinal stringers 24, including a central keel rod 26. The stringers 24 and keel rod 26 span the ribs 18 and are cradled by the stringer-engaging clips 22.

The keel rod 26 is symmetrically disposed with respect to the pair of gunwales 16. The keel rod 26 has a bow extension 28, which extends the keel rod 26 to a bow junction region 30 of the pair of gunwales 16, and a stern extension 32 (shown in FIG. 4), which extends the keel rod 26 to a stern junction region 34 of the pair of gunwales 16. Thwarts 36 are provided which are fixably attached to a selected subset of the ribs 18 to stabilize the gunwales 16 and provide additional rigidity to the frame 12. Alternatively, the thwarts 36 could be attached directly to the gunwales 16.

The skin 14 is supported by the frame 12, which the skin 14 spans. A portion of the skin 14 is illustrated in the exploded isometric view of FIG. 2, which shows the region of the skin 14 which covers the bow region of the collapsible canoe 10. The skin 14 has a pair of gunwale sleeves 38, to which are attached a pair of side panels 40. The side panels 40 are in turn attached to a bottom panel 42.

When the collapsible canoe 10 is assembled, the pair of gunwales 16 slidably engage the gunwale sleeves 38. FIG. 3 is a view of section 3—3 of FIG. 1, and better shows the construction of one of the gunwale sleeves 38. Rib openings 44 are provided in the gunwale sleeves 38 to allow attachment of the ribs 18 to the pair of gunwales 16. The gunwale sleeves 38 are constructed of a double-sided polymer-coated woven cloth, having a fabric substrate 46 which is typically woven from a nylon yarn and coated on both sides with a waterproof polymer coating 48, such as vinyl.

The side panels 40 are also constructed of a double-sided polymer-coated woven fabric, coated on both sides with a polymer. The side panels 40 are typically thinner than the gunwale sleeves 38, since the side panels 40 are not subject to the stresses or abrasion to which the gunwale sleeves 38 are subject. Again, the woven fabric is typically woven from a nylon yarn.

The bottom panel 42 of the Scansport collapsible canoe is also formed from a double-sided polymer-coated fabric, coated on both sides with a polymer. The double-sided polymer coated fabric employed for the bottom panel 42 will generally be thicker than that employed in the side panels 40, since the bottom panel 42 is subject to greater stresses and abrasion than are the side panels 40. The woven fabric employed in the bottom panel 42 is again typically woven from a nylon yarn and is generally similar to the material used for the gunwale sleeves 38.

A foam pad 50 is preferably provided, which resides between the bottom panel 42 and the frame 12. While such foam pads 50 have, in the past, typically been simply placed between the bottom panel 42 and the frame 12, in the collapsible canoe 10 the foam pad 50 employed in a ScanSport canoe is bonded to the bottom panel 42, eliminating the chance of water accumulating between the bottom panel 42 and the foam pad 50. Such lamination of the foam pad 50 to the bottom panel 42 is also taught in the '634 patent, which teaches that the foam pad 50 may be alternatively attached to the bottom panel 42 by sewing. The foam pad 50 is typically a closed-cell foam and engages the stringers 24 and the keel rod 26 when the collapsible canoe 10 is assembled. The foam pad 50 mitigates abrasion of the bottom panel 42 when the bottom panel 42 encounters a foreign object such as a rock by providing cushioning between the bottom panel 42 and the frame 12. The foam pad 50 also provides additional flotation capacity in the event that the collapsible canoe 10 is swamped.

The gunwale sleeves 38, the side panels 40, and the bottom panel 42, when sewn together, form the skin 14. A heat sealable tape 52 (shown in FIGS. 2 and 4) is placed over the sewn seams between the bottom panel 42 and the side panels 40, as well as over seams at the bow and stern, where the side panels 40 join each other and are joined to bottom panel extensions 54. The heat sealable tape 52 bonds to both the side panels 40 and the bottom panel 42 to assure that the seams remain water-tight. The seams between the gunwale sleeves 38 and the side panels 40 are not covered with heat sealable tape 52, since these seams are not submerged in normal usage.

As shown in FIG. 4, the skin 14 will preferably include a pair of inflatable flotation compartments 56 which reside between the side panels 40 and the frame 12 when the collapsible canoe 10 is assembled. The inflatable flotation compartments 56, when inflated, help maintain the skin 14 tautly in place on the frame 12. The inflatable flotation compartments 56 also provide increased stability and floatability of the collapsible canoe 10 if swamped. It is preferred for the inflatable flotation compartments 56 to be attached to the skin 14 with straps 58 which pass through strap eyelets 60 in the gunwale sleeves 38 and through the rib openings 44. The attachment of the inflatable flotation compartments 56 with straps 58 facilitates replacement if damaged. Preferably, a flotation compartment support rod 62 is provided on either side of the collapsible canoe 10, and resides between the inflatable flotation compartments 56 and the ribs 18. The flotation compartment support rods 62 provide longitudinal support for the inflatable flotation compartments 56 to improve the appearance of the collapsible canoe 10.

The '634 patent teaches an alternative to the inflatable flotation compartments 56. In the collapsible canoe of the '634 patent, the skin is provided with anti-flex covers which are bonded to the skin on either side so as to form an envelope. A multi-chambered anti-flex air bladder resides in each of the envelopes formed by the anti-flex covers, and the anti-flex air bladders are inflated to both tension the skin and to provide greater rigidity to the collapsible canoe. The anti-flex system of the '634 patent requires the anti-flex covers to be bonded to the skin to form an envelope which anchors the anti-flex air bladders to the skin, increasing the complexity of fabrication of the skin, making replacement difficult, and increasing the difficulty of conforming the shape of the anti-flex air bladders to the shape of the frame. The multi-chamber anti-flex air bladders do not allow for replacement of an individual air chamber which is damaged. Rather, the entire air-bladder must be replaced. Additionally, the anti-flexing system of the '634 patent requires side stringers to retain the position of the anti-flex air bladders, rather than employing free-floating support rods such as the flotation compartment support rods 62 which are employed to provide longitudinal support for the inflatable flotation compartments 56. The side stringers are clipably attached to the ribs and tied in to the bow and stern extensions of the keel rod, complicating fabrication of the frame as well as assembly and disassembly of the collapsible canoe of the '634 patent.

The collapsible canoe 10 preferably also includes end covers 64, which can be attached to the bow and stern of the collapsible canoe 10 with snaps. The end covers 64 provide greater protection against the ingress of water and to improve the appearance of the collapsible canoe 10.

Collapsible canoes such as described above are difficult to assemble and disassemble, since the gunwales 16 tend to bind due to friction between the gunwales 16 and the polymer coating 48 of the gunwale sleeves 38. This binding makes it difficult to insert the gunwales 16 into or remove them from the gunwale sleeves 38. Frequently, lubricants are used to aid in the installation of the gunwales 16 into the gunwale sleeves 38.

Since the gunwales 1.6 are usually constructed from a series of tubular members fitted together, which are liable to pull apart under tension, the gunwales 16 are typically removed by pushing them out of the gunwale sleeves 38 with a tubular member (not shown) of similar diameter to the gunwales 16. This method of removal requires each gunwale sleeve 38 to have a passage 66 which is sized only slightly larger than the gunwales 16, to provide guidance for the tubular member to prevent it from sliding alongside the gunwale 16 and wedging it into the gunwale sleeve 38. The problem of binding is aggravated by having gunwale sleeves 38 with passages 66 only slightly larger than the gunwales 16, as illustrated in FIG. 3.

The use of the double-sided polymer-coated fabric for the bottom panel 42 makes it difficult to reliably bond the foam pad 50 thereto. When the polymer coating is a vinyl, such coatings typically include plasticizers, which generate volatiles which interfere with the bonding of the foam pad 50 and can result in delamination of the foam pad 50 from the bottom panel 42. While the foam pad 50 could be sewn to the bottom panel 42, as is taught in the '634 patent, such attachment complicates fabrication of the skin 14. Additionally, when the foam pad 50 is sewn to the bottom panel 42, leaks in the bottom panel 42 or the foam pad 50 could allow water to accumulate between the bottom panel 42 and the foam pad 50.

The prior art devices for inflatably tensioning the skin with respect to the frame do not allow for replacement of individual elements which may be damaged, and do not provide an option between temporary or permanent attachment to the skin.

Thus, there is a need for an improved skin for a collapsible canoe which will assure the easy assembly and provide a skin which is easier to manufacture without risk of delamination. There is also a need for a skin which uses individually replaceable elements to tension the skin and which provides flexibility in the manner of attachment of such elements to the skin.

SUMMARY OF THE INVENTION

The present invention relates to a composite skin for a collapsible canoe. The composite skin is fitted over a frame which includes a pair of gunwales, ribs, and stringers including a keel rod, as described in the background of the invention. The composite skin covers the frame and is secured to the frame by providing a pair of gunwale sleeves of a polymer-coated fabric into which the qunwales or the frame slidably engage.

The composite Skin preferably has a pair of polymer-coated side panels which attach to the gunwale sleeves, and a polymer-coated bottom panel, which in turn is attached to the side panels. A bow closure and stern closure are formed at either end of the side panels to complete the composite skin. Preferably, the bottom panel has a foam pad attached thereto.

The improvement of the present invention resides in part in the construction of the polymer-coated gunwale sleeves. The improved gunwale sleeves each have a fabric surface which lines the gunwale sleeve to provide a surface with reduced friction. The fabric surface is preferably a woven fabric made from a polymer yarn such as nylon or polyester. Preferably, the fabric surface is provided on the polymer-coated fabric substrate. In all cases, the resulting qunwale sleeve is provided with a as nylon or polyester. Preferably, the fabric surface is provided on the polymer-coated fabric substrate. In all cases, the resulting gunwale sleeve is provided with a fabric surface which forms the surface of the passage which slidably engages the gunwales. This fabric surface reduces the friction between the gunwales and the gunwale sleeves as the gunwales are positioned, aiding in the insertion and removal or the gunwales without binding, and thereby facilitating the ease with which the collapsible canoe can be assembled and disassembled.

The side panels of the composite skin are preferably fabricated from a woven fabric having a polymer coating on both sides or the fabric. Since the side panels are not as subject to stresses as the gunwale sleeves, they may be constructed of a lighter weight fabric to reduce overall weight or the composite skin.

It is preferred for the bottom panel to be constructed from a single-sided polymer-coated fabric having a bottom fabric substrate which in turn has an uncoated inner surface and an outer surface which is coated with a bottom polymer coating. Having the bottom panel only coated on its outer surface facilitates attaching the foam pad to the inner surface of the bottom fabric substrate. The lack of coating on the inner surface of the bottom fabric substrate eliminates the problems of volatiles due to plasticizers and provides more reliabie bonding of the foam pad to the bottom fabric substrate. Additionally, providing coating only on the outer surface of the bottom fabric substrate allows for providing a thicker, tougher outer surface for the composite skin without an increase in weight. These features of the bottom panel have utility independent of their use in combination with the above described gunwale sleeves.

The composite skin can be constructed in a sequence similar to that of the prior art collapsible canoe skin discussed previously. In this sequence, the gunwale sleeves are attached to the side panels with a double stitched seam, and then the side panels are attached to the bottom panel with a double sewn seam. The side panels are then sewn to bottom panel extensions to form bow and stern closures. Heat sealing tape is then applied over the seams between the side panels and the bottom panel and over the bow and stern closures.

In a preferred embodiment, the composite skin is constructed by attaching the gunwale sleeves to the side panels with a double stitched seam, and the side panels are attached to the bottom panel with a heat sealed seam. The heat sealed seam is preferably provided by overlapping the polymer-coated surfaces of the side panel and bottom panel by at least about ¾ (three-quarters) inch, inserting hot air to heat the polymer coatings of the side panel and the bottom panel, and then pressing the side panel and bottom panel together. In this embodiment, the bow and stern closures may be heat-sealed, or they may be sewn in the same manner as in the embodiment discussed above.

To further protect the bottom panel from abrasion, it is preferred for the bottom panel to be provided with one or more rub strips. Each rub strip is provided by bonding a strip of a polymer film onto the polymer-coated outer surface of the bottom panel, preferably by heat-fusing. The rub strips are positioned to run longitudinally on the bottom panel so as to correspond to the positions of the keel rod and stringers of the frame.

It is also preferred for the collapsible canoe to be provided with a pair of side flotation compartments in place of the inflatable flotation compartments employed in the prior art collapsible canoe. The side flotation compartments are formed by flotation chamber sleeves which are configured to accept a plurality of individually removable flotation chambers. The tlotation chambers can be individually removed for repair or replacement, so it is not necessary to replace the entire side flotation compartment in case of damage. The side flotation compartments may be attached to the composite skin with straps, or may be permanently attached to the composite skin. In one embodiment, the flotation chamber sleeves are sewn to the composite skin with a double stitched seam which also serves to attach the gunwale sleeves to the side panels.

The flotation chamber sleeves are sized such that, when the flotation chambers are inserted therein and inflated, the flotation chamber sleeves provide structural support for the flotation chambers. Since the flotation chamber sleeves provide structural support and protect the flotation chambers from abrasion, the flotation chambers may be fabricated from a polymer film which, by itself, has relatively low tensile strength and abrasion resistance. When the flotation chambers are made from a polymer film such as PVC, they can readily be repaired in the field with common vinyl adhesives, such as would typically be carried for repair of the polymer coating of the canoe skin. Polymer film flotation chambers are also relatively inexpensive, making it practical to carry several spare flotation chambers when long trips are contemplated.

BRIEF DESCRIPTION OF THE DRAWINGS

FIG. 7 also shows a heat sealing tape which covers a double sewn seam which attaches the bottom panel to a side panel. The bottom panel of this embodiment can be used in combination with either of the gunwale sleeves shown in FIGS. 5 and 6.

BEST MODE FOR CARRYING THE INVENTION INTO PRACTICE

Figure 5:
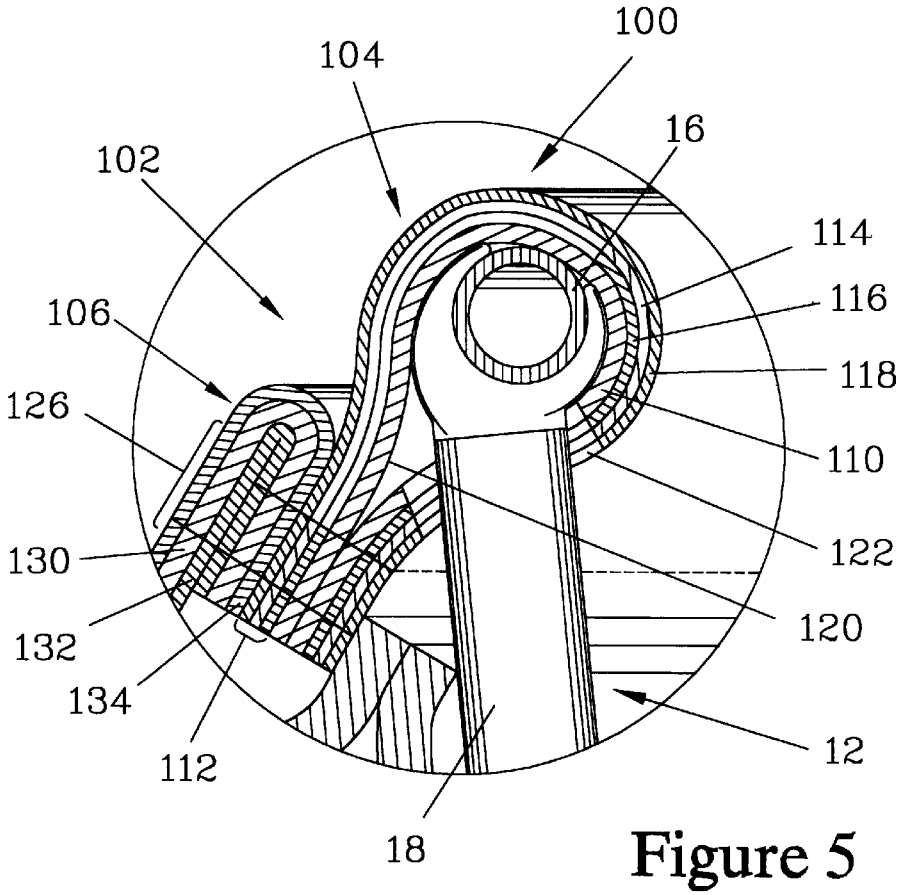
FIG. 5 is a partial view of one embodiment of the present invention, and corresponds to the view of FIG. 3. This embodiment employs gunwale sleeves fabricated from a double-sided polymer-coated sleeve fabric to which has been added a fabric layer. The fabric layer provides a fabric surface which lines the gunwale sleeve.
Figure 7:
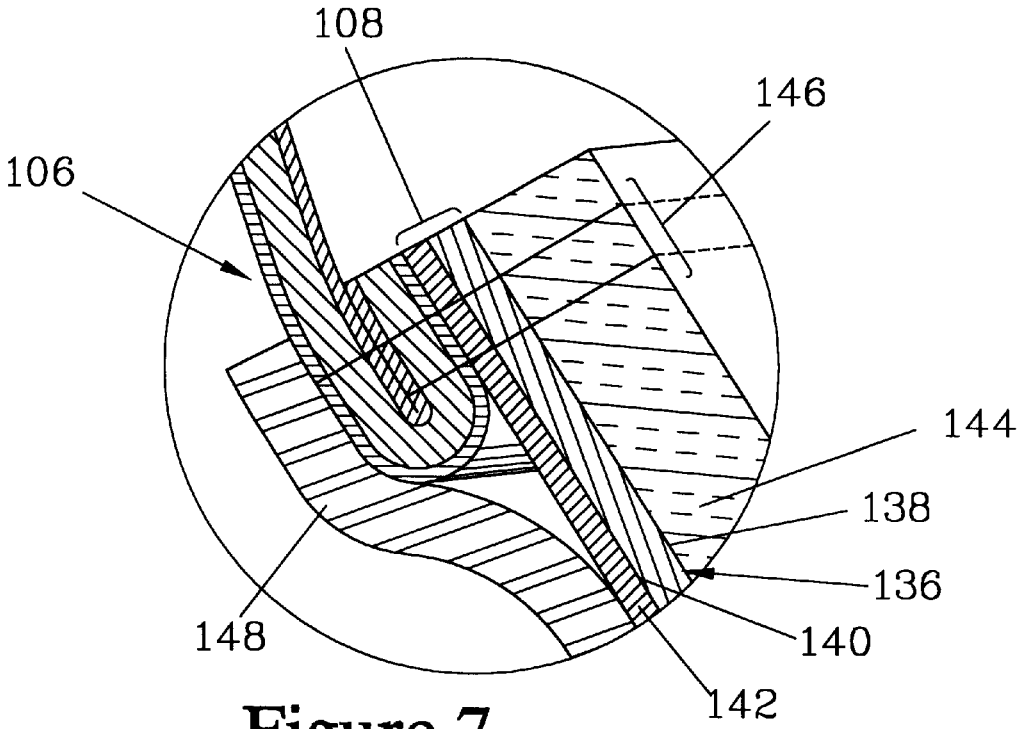
FIG. 7 is a partial view showing part of a bottom panel of the present invention. The bottom panel is fabricated from a bottom fabric substrate where only one side has been polymer-coated. A foam pad is bonded to the uncoated side of the bottom panel.
Figure 8:
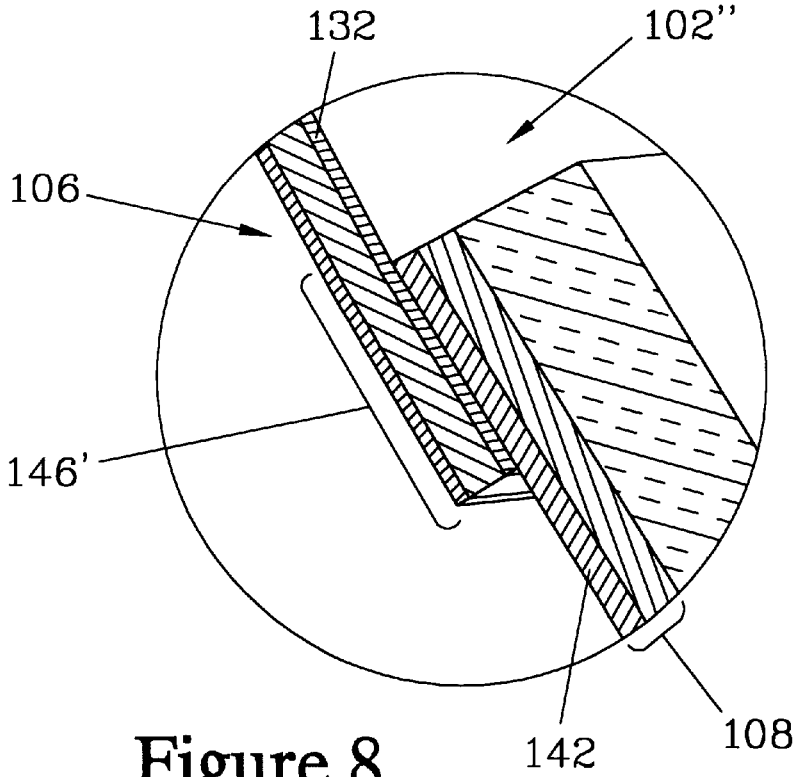
FIG. 8 is a partial view of an embodiment of the present invention where a heat-fused seam is employed to attach the bottom panel to the side panel. This

FIG. 5 is a partial sectional view of a collapsible canoe 100 which employs the frame 12 of the prior art collapsible canoe 10 discussed previously. The collapsible canoe 100 has a composite skin 102 having a pair of fabric-lined gunwale sleeves 104 which provide one of the improvements of the present invention. As with the prior art skin 14, the composite skin 102 engages the gunwales 16 and spans the keel rod 26 and the stringers 24 of the frame 12. The composite skin 102, in addition to the pair of gunwale sleeves 104, has a pair of side panels 106 attached to the pair of gunwale sleeves 104. The side panels are in turn attached to a bottom panel (not shown). The bottom panel used may be a double-sided polymer-coated bottom panel 42 such as is employed in the prior art skin 14, or may be a single-sided polymer-coated bottom panel 108 which is illustrated in FIGS. 7 and 8, and which will be described in greater detail in the discussion of those figures.

In the embodiment illustrated in FIG. 5, the gunwale sleeves 104 have a fabric layer 110 which forms the inner surface of the tabric-lined gunwale sleeves 104. The gunwale sleeves 104 are constructed with double-coated sleeve fabric 112 having a fabric substrate 114, which in turn has a fabric substrate inner polymer coating 116 and a fabric substrate outer polymer coating 118. The fabric layer 110 is uncoated and is positioned adjacent the fabric substrate inner polymer layer 116, and the double-coated sleeve fabric 112 and the fabric layer 110 are folded such that the fabric layer 110 is folded onto itself, providing an uncoated fabric surface 120 of the gunwale sleeve 104, along which the gunwales 16 slide when being inserted into or withdrawn from the gunwale sleeves 104. The fabric layer 110 of each of the gunwale sleeves 104 provides the fabric surface 120 which lines the gunwale sleeve 104, reducing the friction and facilitating the movement of the gunwales 16 in the gunwale sleeves 104. The gunwale sleeves 104 are provided with rib openings 122, which allow the ribs 18 to pass through the gunwale sleeves 104 to clipably engage the gunwales 16. It is preferred that the fabric substrate 114 be a polyester substrate having a denier of between 800 and 1400, and more preferably about 1100, as such fabric exhibits resistance to stretching. A polyester substrate provides better dimensional stability, resulting in more consistent tension of the composite skin 102, thereby increasing the rigidity of the collapsible canoe 100. It is also preferred for the resultant polymer-coated sleeve fabric 112 to have a weight of 25–40 ounces/square yard and a tear resistance of at least 150 lbs. The fabric layer 110 is preferably woven nylon or polyester fabric.

Figure 6:
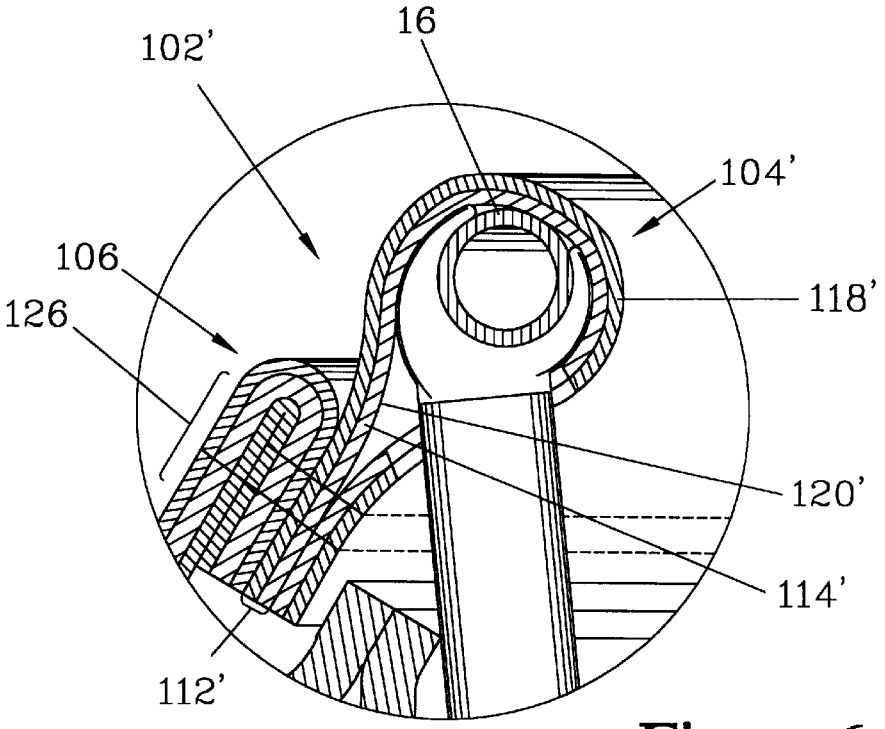
FIG. 6 is a partial view of an embodiment of the gunwale sleeve which is an alternative to the embodiment shown in FIG. 5. In this embodiment, the gunwale sleeve is constructed from a single-sided polymer-coated sleeve fabric having a substrate which in turn has an inner fabric surface, which is uncoated, and an outer polymer coating. The inner fabric surface provides a fabric surface which lines the gunwale sleeve.

FIG. 6 illustrates an alternative embodiment of a composite skin 102' of the present invention. This embodiment employs gunwale sleeves 104' which are constructed from a single-coated sleeve fabric 112' having a sleeve fabric substrate 114, which in turn has an uncoated fabric surface 120' and a fabric substrate outer polymer coating 118'. The single-coated sleeve fabric 112' is folded such that the fabric surface 120' is folded onto itself to configure the fabric surface 120' to line the gunwale sleeve 104'. The fabric surface 120' engages the gunwale 16 when the gunwale 16 is inserted into the gunwale sleeve 104'. It is preferred that the fabric substrate 114 be a woven polyester substrate having a denier of between 800 and 1400, and more preferably about 1100. It is also preferred for the single-coated sleeve fabric 112' to have a weight of 25–40 ounces/square yard and a tear resistance of at least 150 lbs.

The gunwale sleeves 104 and 104' discussed above and illustrated in FIGS. 5 and 6 are preferably attached to the side panels 106 with a double stitched seam 126. The sleeve fabrics (112 and 112') are folded to form gunwale sleeves (104, 104'), and the gunwale sleeves (104, 104') are sewn to the side panel 106. The edge of the side panel 106 is then folded and the seam is resewn to form the double stitched seam 126. Constructing the gunwale sleeves (104 and 104') as separate components allows for configuring the gunwale sleeves (104 and 104') to provide a smoother tit to the curved shape of the gunwales 16 than would be possible if the gunwale sleeves (104 and 104') were formed integrally with the side panels 106.

The side panels 106 have a side fabric substrate 130 to which has been applied a side fabric inner polymer coating 132 and a side fabric outer polymer coating 134. The inner polymer coating 132, while not required for waterproofing, is preferred for easier cleaning and improved appearance of the side panels 106. The side fabric substrate 130 is preferably woven from a polymer yarn having a denier between 400 and 600, and more preferably about 500. While nylon may be used for the side fabric substrate 130, polyester is preferred, since it is less liable to stretch. When the side fabric substrate 130 is polymer-coated on both sides, it is preferred that the side panels 106 have a weight of 16–20 ounces/square yard, and more preferably about 18 ounces/square yard, and have a tear strength of at least 75 lbs.

FIG. 7 illustrates the bottom panel 108 which differs from the prior art bottom panel 42 in that the bottom panel 108 has a bottom fabric substrate 136, having an inner surface 138 which is uncoated and an outer surface 140, to which is applied a bottom polymer coating 142. The bottom polymer coating 142 forms the external surface of the bottom panel 108 of the collapsible canoe 100, as is better shown in FIG. 9. The elimination of a polymer layer from the inner surface 138 of the bottom fabric substrate 136 al lows the bottom polymer coating 142 to be thicker, which increases the abrasion resistance of the composite skin 102, without an increase in weight. The bottom fabric substrate 136 is preferably a woven fabric having a polymer yarn having a denier of between 800 and 1400, and more preferably about 1100, and it is also preferred that the bottom fabric substrate 136 be polyester. It is further preferred that the coated fabric formed by the combination of the bottom fabric substrate 136 and bottom polymer coating 142 have a weight of 25–40 ounces/square yard and a tear strength of at least 150 lbs.

Preferably, the bottom panel 108 has a foam pad 144 permanently affixed thereto. The inner surface 138 of the bottom fabric substrate 136 is adjacent to the foam pad 144 and is preferably attached thereto with an adhesive (not shown). The elimination of a polymer coating on the inner surface 138 of the bottom fabric substrate 136 promotes bonding between the foam pad 144 and the bottom fabric substrate 136, since adhesives bond better to an untreated fabric surface than to a polymer coating material. When the bottom fabric substrate 136 is polyester, the foam pad 144 may be affixed with a urethane-based adhesive.

The foam pad 144 is a closed-cell Loam material such as polyethylene or polypropylene. Polypropylene, while generally more expensive than polyethylene and often less available, provides a greater strength-to-weight ratio, resulting in less compression and greater durability, as well as improved bonding with most adhesives. The foam pad 144 is preferably a foam with a thickness between ⅛ (one-eighth) and ½ (one-half) inch, and a density of between 2 and 6 lb/cubic foot. It has been found that a polyethylene foam pad of ¼ (one-quarter) inch thickness, having a density of 4 lb/cubic foot provides sufficient protection of the bottom panel 108. A polyethylene foam pad having a thickness of ⅛ (one-eighth) inch and a density of 6 lb/cubic foot was found to be undesirably hard and thin, resulting in inadequate protection of the bottom panel 108 from abrasion. A polyethylene foam pad having a thickness of ½ (one-half) inch and a density of 2 lb/cubic foot was found to be undesirably soft, compressing against the ribs 18, stringers 24, and keel rod 26, to provide protection slightly better than that of the ¼ inch foam, while having greatly increased bulk, increasing the size of the collapsible canoe when disassembled for transport.

FIG. 7 also illustrates one means for attaching the side panels 106 to the bottom panel 108. The means illustrated in FIG. 7 is used in the collapsible canoes marketed by ScanSport, and does not constitute an element of the present invention. FIG. 7 shows a double sewn seam 146 for attaching the side panels 106 to the bottom panel 108. The double sewn seam 146 is formed in a manner similar to that of the double stitched seam 126 which joins the gunwale sleeve 104 to the side panel 106. A heat sealing tape 148 is applied over each of the double sewn seams 146. The heat sealing tape 148 is bonded to the bottom polymer coating 142 oo the bottom panel 108 and to the outer polymer coating 134 of the side panels 106. The double sewn seams 146 are preferably located somewhat above the outermost stringers 24 of the frame 12 so as to be less exposed to abrasion than it they are located adjacent the stringers 24. Placing the double sewn seams 146 about 2 inches above the outermost stringers 24 has been found effective.

Heat sealing tape 148 is preferably also employed for the bow and stern seams; however, these seams are typically not folded in the manner of the double sewn seams 146 between the side panels 106 and the bottom panel 108. It should be noted that, in the case of the double stitched seams 126 between the gunwale sleeves 104 and the side panels 106, it is not necessary to waterproof the double stitched seam 126 with a heat sealing tape, as the position of the seam 126 will prevent it from being immersed during regular usage.

FIG. 8 illustrates the construction of a heat-fused seam 146' which provides an alternative means for attaching the side panels 106 to the bottom panel 108. The heat-fused seam 146' speed s fabrication and eliminates the need to employ the heat sealing tape 148, as the heat-fused seam 146' is sufficiently strong and waterproof by itself.

In creating the heat-fused seam 146', the side panel 106 and the bottom panel 108 are positioned such that they overlap by at least about ¾ (three-quarters) inch. In this embodiment, the surfaces to be joined must both be polymer-coated. The heat-fused seam 146' can be formed by injecting hot air between the side panel 106 and the bottom panel 108 to heat them, and then passing the side panel 106 and the bottom panel 108 between rollers, which press them together to fuse the side fabric inner polymer coating 132 of the side panel 106 to the bottom polymer coating 142 of the bottom panel 108. While such a method allows for faster fabrication of the heat-fused seam 146' than is possible with sewing, it requires adequate precision in the alignment of the side panels 106 and the bottom panel 108 during the fabrication process. While not shown, the bow and stern closures could be similarly heat-bonded rather than sewn, but in the case of the bow and stern seams, positioning will be even more difficult due to the curvature of the material being bonded.

As noted above, when a heat-fused seam 146' is employed to attach the side panels 106 to the bottom panel 108, the inner polymer coating 132 of the side panels 106 is required for adequate bonding to the bottom polymer coating 142. The inner polymer coating 132 of the side panel 106 and the bottom polymer coating 142 must be compatible, heat-sealable coatings. PVC and urethane are two polymer coating materials which can be effectively heat-fused.

Figure 1:
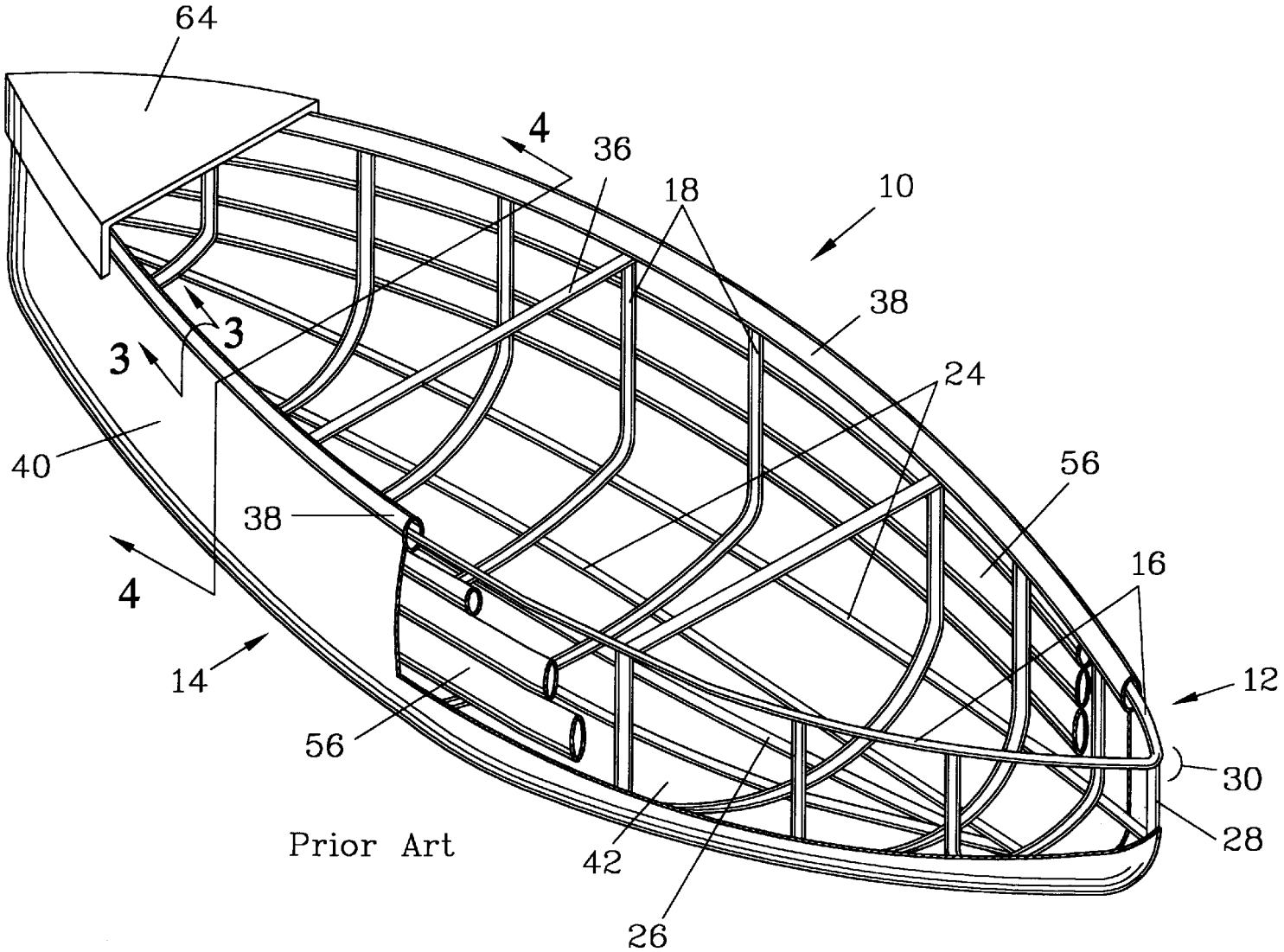
FIG. 1 is an isometric view of a prior art collapsible canoe, where part of the skin has been removed to better show the frame and related structure of the collapsible canoe.
Figure 2:
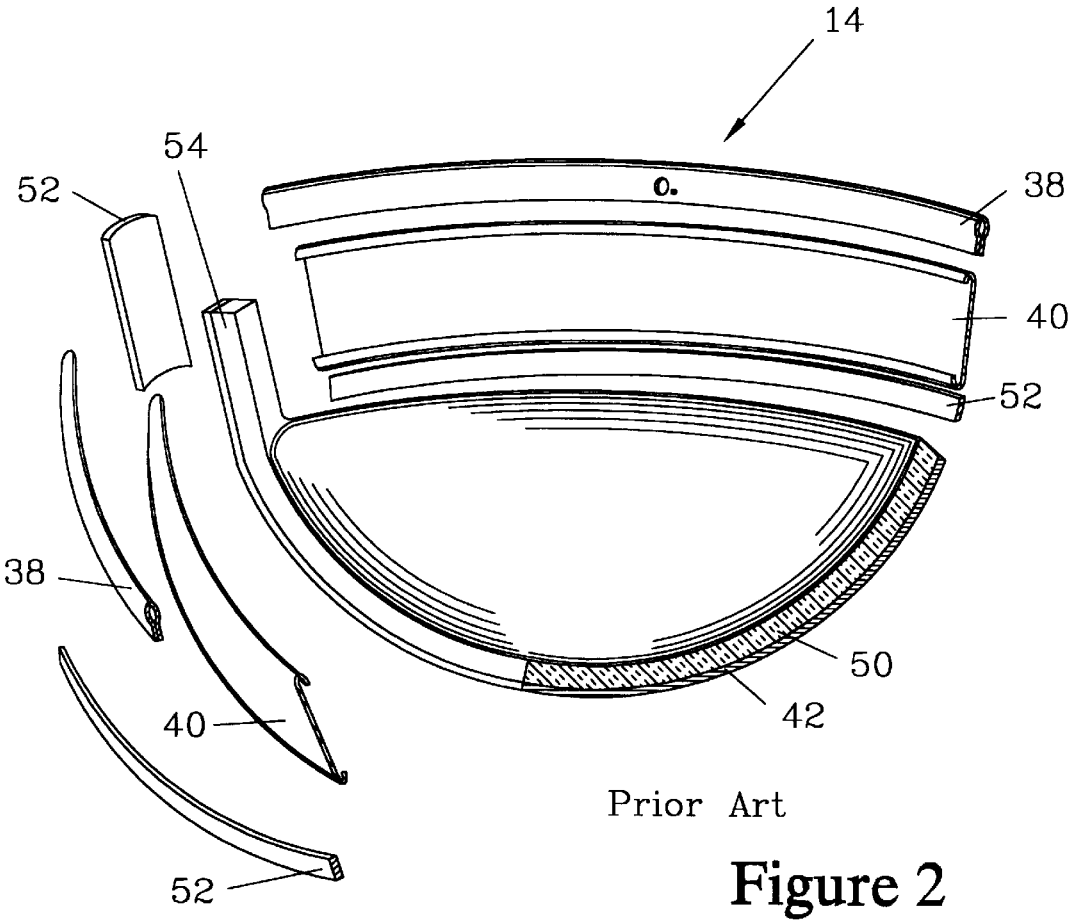
Prior Art Figure 2
FIG. 2 is an exploded isometric view of a section of the skin which covers the bow region of the prior art collapsible canoe shown in FIG. 1.
Figure 3:
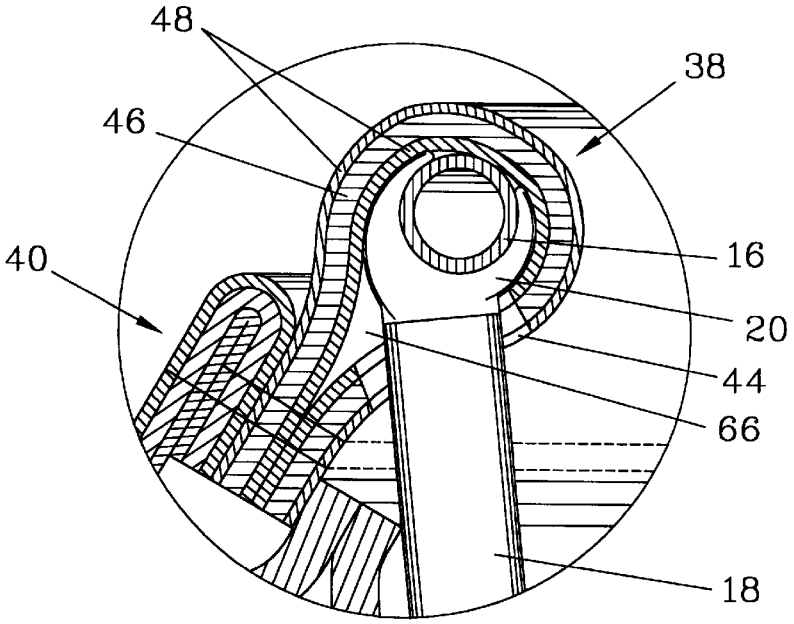
Prior Art Figure 3
FIG. 3 is a view of the section 3—3 of FIG. 1 showing details of a qunwale-engaging clip, one of the gunwale sleeves, and the sewn seam which attaches the gunwale sleeve to a side panel. The gunwale sleeve illustrated in FIG. 3 is fabricated from double-sided polymer-coated cloth.
Figure 4:
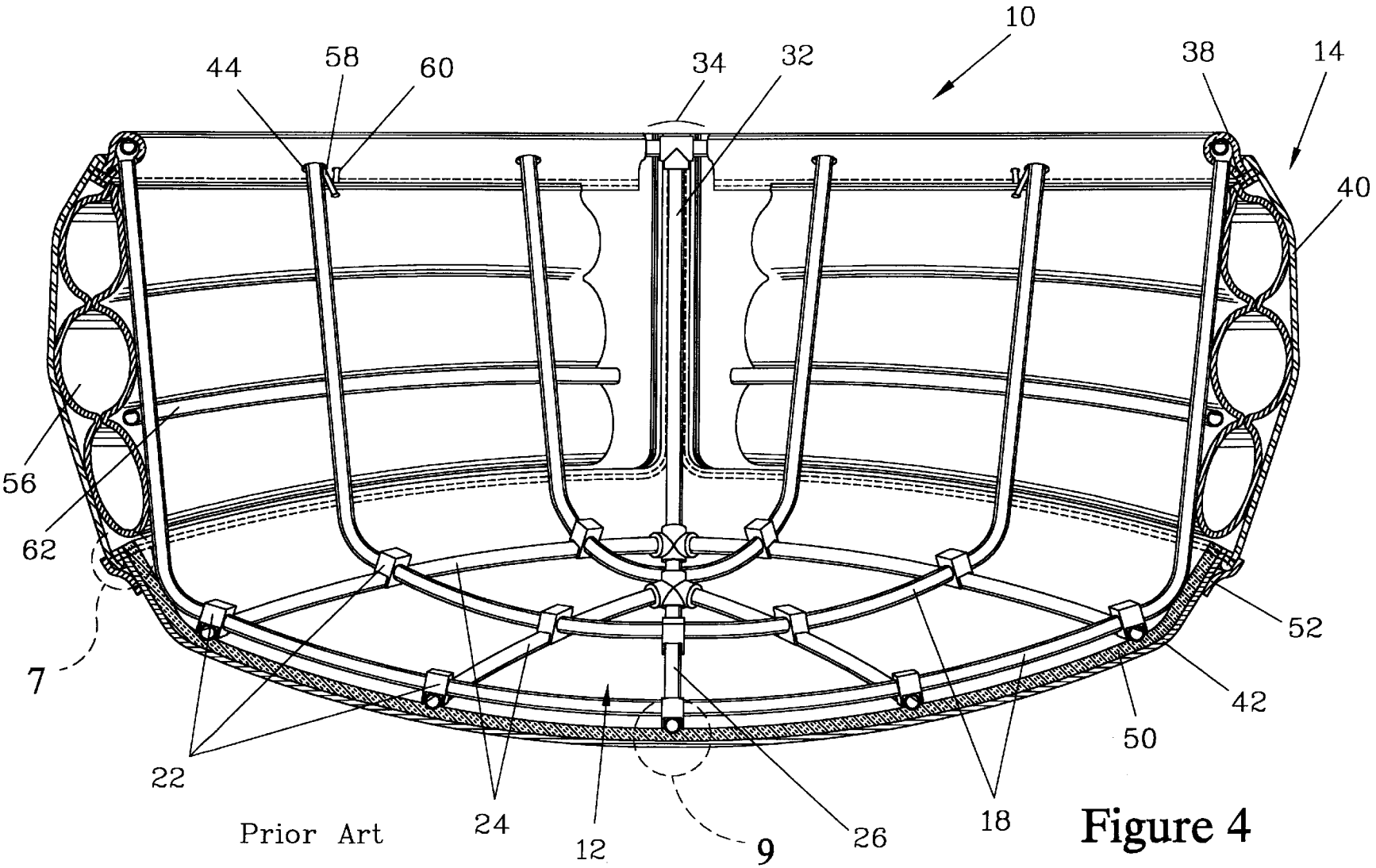
Figure 4 Prior Art
FIG. 4 is a view of the section 4—4 of FIG. 1. The individual layers of the polymer-coated fabrics are not illustrated, but rather are treated collectively as a single layer for purposes of illustration.
Figure 9:
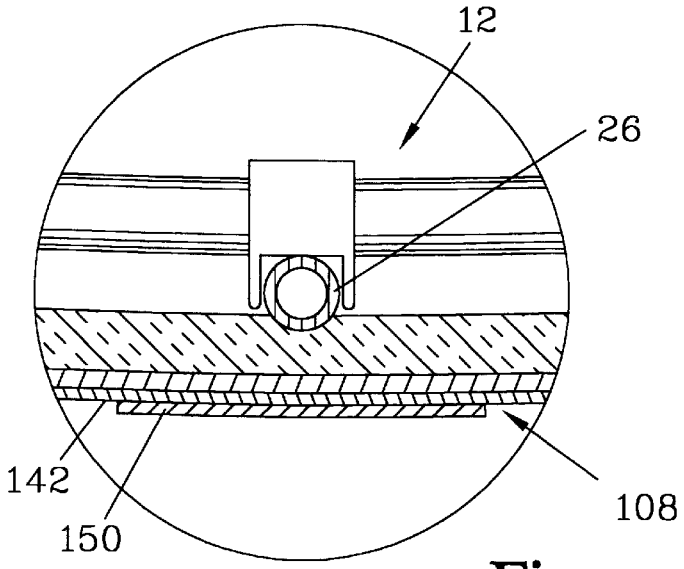
FIG. 9 is an enlarged view showing the central region of the bottom panel shown in FIGS. 7 and 8. The bottom panel of this embodiment has a rub strip which is bonded to the bottom panel, providing increased resistance to abrasion.

It is preferred for the bottom panel 108 to be provided with at least one rub strip 150, as illustrated in FIG. 9, for increased resistance to abrasion in the regions of the bottom panel 108 which overlie the keel rod 26 and/or stringers 24 of the frame 12. To clarify the location of the region depicted in FIG. 9 relative to the frame 12, the corresponding region is circled and numbered in FIG. 4. The rub strip 150 at the present invention is a strip of polymer film, typically of a polymer similar to that of the bottom polymer coating 142. The rub strip 150 is bonded onto the bottom polymer coating 142 of the bottom panel 108, preferably by heat-bonding. The rub strip 150 provides the effect of a localized increased thickness for the bottom polymer coating 142. A polymer film having a thickness of about 30 mil and a width of about 3 inches has been found to be effective in providing the rub strip 150. In the composite skin 102 illustrated, only a single rub strip 150 is employed, which runs longitudinally on the bottom panel 108 and is positioned to correspond to the position of the keel rod 26 of the frame 12. Since the area of the bottom panel 108 which overlies the keel rod 26 is the lowest point on the composite skin 102, it will be especially prone to contact with rocks and similar foreign objects, and the added abrasion resistance provided by the rub strip 150 will be especially desirable. Similar rub strips could be provided on the regions of the bottom panel 108 which overlie some or all of the stringers 24.

Figure 10:
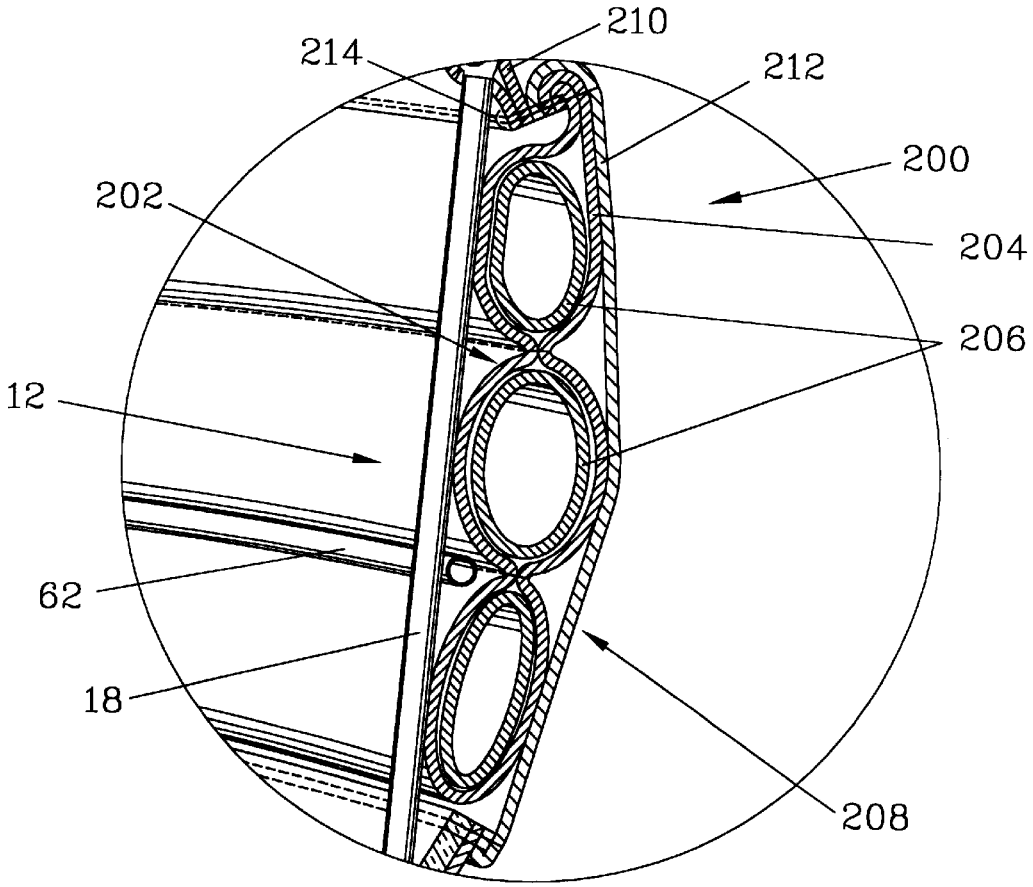
FIG. 10 is a section view of another embodiment of the present invention, which employs side flotation compartments which are designed to be substituted for the prior art inflatable flotation compartments shown in FIGS. 1 and 4. The side flotation compartments are formed by flotation chamber sleeves having flotation chambers slidably engaged therein, and can be made an integral part of the canoe skin.

FIG. 10 illustrates a section of a collapsible canoe 200 which includes a pair of side flotation compartments 202, which are designed to be substituted for the prior art inflatable flotation compartments 56 employed with the prior art skin 14. The side flotation compartments 202 are formed by flotation chamber sleeves 204, which are configured to accept a plurality of individually removable flotation chambers 206. The collapsible canoe 200, as illustrated, employs a frame such as the frame 12 discussed previously, and a skin 208.

Employing discrete flotation chambers 206 which are individually removable from the flotation chamber sleeves 204 facilitates repair or replacement it one of the flotation chambers 206 is damaged. A flotation chamber which is damaged can be removed from the flotation chamber sleeve 204 for repair or replacement without removing the other flotation chambers 206. The undamaged flotation chambers 206 can continue to tension the composite skin 202, and can provide flotation and stability.

Since the flotation chambers 206 can be individually removed for replacement or repair, the side flotation compartments 202 can be permanently attached to the skin 208 of the collapsible canoe 200, as is shown in FIG. 10. Alternatively, the side flotation compartments 202 could be attached to the skin 208 by straps, in the manner employed to attach the inflatable flotation compartments 56 in the prior art canoe 10. Attachment of the side flotation compartments 202 to the skin 208 with straps allows for separate replacement of either the side flotation compartments 202 or the skin 208 in the case that one of these is damaged, and additionally allows the advantages of the side flotation compartments 202 of the present invention to be readily retrofitted into pre-existing canoe skins.

The skin 208 illustrated has gunwale sleeves 210 which are attached to side panels 212. When the skin 208 is so constructed, the flotation chamber sleeves 204 can be attached to the gunwale sleeves 210 and the side panels 212 of the skin 208 with a double stitched seam 214, which also serves to attach the gunwale sleeves 210 and the side panels 212 together. This double stitched seam 214 is formed in a manner similar to the double stitched seam 126 discussed previously, with the flotation chamber sleeve 210 placed alongside the side panel 212 prior to stitching the side panel 212 to the gunwale sleeve 210. The edge of the side panel 212 and the flotation chamber sleeve 204 are then folded and the seam is resewn to form the double stitched seam 214. Attaching the side flotation compartments 202 to the skin 208 with the double stitched seam 214 prevents sand and other debris from getting wedged between the side panels 212 and the side flotation compartments 202. It should be noted that the side flotation compartments 202 need only be attached to the skin 208 along a single seam, rather than being anchored to the skin in the manner of the anti-flex system discussed in the '634 patent. Attaching the side flotation compartments 202 to the skin 208 along a single seam facilitates fabrication and allows the side flotation compartments 202 to better conform to the shape of the frame 12, improving the appearance of the collapsible canoe 200.

The flotation chamber sleeves 204 are sized such that, when the flotation chambers 206 are inserted therein and inflated, the flotation chamber sleeves 204 provide structural support for the flotation chambers 206. Since the flotation chamber sleeves 204 provide structural support and protect the flotation chambers 206 from abrasion, the flotation chambers 206 may be fabricated from a polymer film which, by itself, has relatively low tensile strength and abrasion resistance, such as PVC. Constructing the flotation chambers 206 from a polymer film allows them to be readily repaired in the field with conventional adhesives. When the flotation chambers 206 are constructed from a polymer film which is chemically similar to the polymer coatings of the composite skin 200, such an adhesive will typically be carried in a repair kit for the composite skin 200, and can be used for repair of the flotation chambers 206 as well. Additionally, PVC flotation chambers 206 can be fabricated inexpensively, making it cost effective to carry several spare flotation chambers 206.

When the collapsible canoe 200 is assembled, the side flotation compartments 202 reside between the side panels 212 and the frame 12. For storage, the flotation chambers 206 are typically deflated while residing in the flotation chamber sleeves 204. After the skin 208 is placed over the frame 12, the flotation chambers 206 are inflated to tension the skin 208 against the frame 12 to maintain the skin 208 tautly in place.

As with the inflatable flotation compartments 56 of the prior art collapsible canoe 10, it is preferred for flotation compartment support rods 62 to be provided, which reside between the side flotation compartments 202 and the ribs 18 of the frame 12. The flotation compartment support rods 62 provide longitudinal support for the side flotation compartments 202 to improve the appearance of the collapsible canoe 200.

Various polymer materials may be employed for the sleeve polymer coatings 116, 118, and 118', the side fabric polymer coatings 132 and 134, and the bottom polymer coating 142. PVC has been found to be a suitable polymer coating material, particularly for polyester fabric substrates. Urethane has improved abrasion resistance and better adhesion to the substrate compared to PVC, but is generally more expensive and reduces the tear strength of the resulting fabric by "locking" the fibers with respect to each other. Special substrates are known in the art for overcoming the problem of reduced tear strength of urethane-coated fabrics. Hypalon has good strength, but cannot be heat sealed, and is generally more expensive than PVC. It is anticipated that the general field of polymer-coated fabrics will continue to develop, and various coatings such as polyethylene, polypropylene, and other polymers which are not yet practical may be readily utilized in the future.

While the novel features of the present invention have been described in terms of particular embodiments and preferred applications, it should be appreciated by one skilled in the art that substitution of materials and modification of details obviously can be made without departing from the spirit of the invention.

What I claim is:

1. An improved collapsible canoe having a frame covered by a composite skin, the frame having, a pair of gunwales, a series of ribs, each rib being connected at each end to one of the gunwales, a series of longitudinal stringers which are supported by the ribs, and thwarts which stabilize the gunwales, the composite skin having, a pair of polymer-coated gunwale sleeves which engage the gunwales of the frame, a pair of polymer-coated side panels, each attached to one of the gunwale sleeves, and a bottom panel of a polymer-coated fabric attached to the pair of side panels, the improvement comprising:

a fabric surface which lines the gunwale sleeves of the composite skin.

2. The improved collapsible canoe of claim 1 wherein each of the gunwale sleeves further comprise:

a sleeve fabric substrate having an inner surface and having an outer surface onto which a polymer coating is applied, said sleeve fabric substrate being folded such that said inner surface of said sleeve fabric substrate faces itself, thereby providing said fabric surface which lines the gunwale sleeve, thereafter said sleeve fabric substrate being attached to one of the pair of polymer-coated side panels.

3. The improved collapsible canoe of claim 2 wherein said sleeve fabric substrate is a woven polyester fiber fabric.

4. The improved collapsible canoe of claim 3 wherein the bottom panel has a bottom fabric substrate of a woven polyester fiber fabric, said bottom fabric substrate having a first side which is polymer-coated and a second side.

5. The improved collapsible canoe of claim 4 wherein the polymer-coated side panels are each constructed of a side fabric substrate which is woven polyester fiber fabric having an inner surface and an outer surface, with a polymer coating applied to said inner and outer surfaces.

6. The improved collapsible canoe of claim 5 wherein said second side of the bottom panel has a foam pad attached thereto.

7. The improved collapsible canoe of claim 6 wherein the bottom panel further comprises:

at least one rub strip, said at least one rub strip being provided by a strip of polymer film bonded to the bottom panel so as to be positioned on an area of said polymer-coated first side which covers at least one of the stringers of the frame.

8. The improved collapsible canoe of claim 1 wherein the bottom panel has a first side which is polymer-coated and the side panels each have an inner polymer coating, and further wherein the bottom panel is attached to each of the side panels with a heat sealed seam, said heat sealed seam bonding a portion of said first side of the bottom panel to said inner polymer coating of the side panel.

9. An improved collapsible canoe having a frame covered by a composite skin, the frame having, a pair of gunwales, a series of ribs, each rib being connected at each end to one of the gunwales, a series of longitudinal stringers which are supported by the ribs, and thwarts which stabilize the gunwales, the composite skin having, a bottom panel of a polymer-coated fabric, a pair of polymer-coated side panels attached to the bottom panel, and a pair of gunwale sleeves, each attached to one of the side panels, the gunwale sleeves engaging the gunwales of the frame, the improvement wherein the bottom panel comprises:

a bottom fabric substrate having a first side and a second side;

a bottom polymer coating on said first side of said bottom fabric substrate, said second side of said bottom fabric substrate being uncoated; and a foam pad attached to said uncoated second side of said bottom fabric substrate.

10. The improved collapsible canoe of claim 9 wherein said bottom fabric substrate is of a woven polyester fiber fabric.

11. The improved collapsible canoe of claim 10 wherein the bottom panel is sewn to the side panels with a double sewn seam.

12. The improved collapsible canoe of claim 10 wherein the side panels each have an inner polymer coating, and further wherein the bottom panel is attached to each of the side panels with a heat sealed seam, said heat sealed seam bonding a portion of said bottom polymer coating of the bottom panel to said inner polymer coating of the side panel.

13. The improved collapsible canoe of claim 10 wherein the bottom panel further comprises:

at least one rub strip, said at least one rub strip being provided by a strip of polymer film bonded to the bottom panel so as to be positioned on an area of said polymer-coated first side which covers a corresponding at least one of the stringers of the frame.

14. The improved collapsible canoe of claim 10 wherein each of the gunwale sleeves further comprise a sleeve fabric substrate having an outer surface onto which a polymer coating is applied, said sleeve fabric substrate being a woven polyester fiber fabric, and wherein the polymer-coated side panels are each constructed of a side fabric substrate which is woven polyester fiber fabric having an inner surface and an outer surface, with a polymer coating applied to said inner and outer surfaces.

15. An improved collapsible canoe having a frame covered by a composite skin, the frame having, a pair of gunwales, a series of ribs, each rib being connected at each end to one of the gunwales, a series of longitudinal stringers which are supported by the ribs, and thwarts which stabilize the gunwales, the composite skin having, a pair of polymer-coated gunwale sleeves which engage the gunwales of the frame, a pair of polymer-coated side panels, each extending downwardly from one of the gunwale sleeves, and a bottom panel of a polymer-coated fabric attached to the pair of side panels, the improvement comprising:

a pair of side flotation compartments which can be attached to the composite skin, each of said pair of side flotation compartments having, a flotation chamber sleeve which is positionable between one of the side panels and the frame; and a plurality of flotation chambers, each of which is configured to be independently slidably inserted into said flotation chamber sleeve and can be inflated to tension the composite skin with respect to the frame.

16. The improved collapsible canoe of claim 15 wherein each of said side flotation compartments is permanently attached to the composite skin.

17. The improved collapsible canoe of claim 16 wherein each of said flotation chamber sleeves is attached to one of the gunwale sleeves and to one of the side panels by a double stitched seam, thereby providing said permanent attachment of said side flotation compartments to the composite skin.

18. The improved collapsible canoe of claim 15 wherein each of said side flotation compartments is attached to the composite skin with straps.

19. The improved collapsible canoe of claim 15 wherein each of the gunwale sleeves further comprise a sleeve fabric substrate having an outer surface onto which a polymer coating is applied, said sleeve fabric substrate being a woven polyester fiber fabric, wherein the bottom panel has a bottom fabric substrate of a woven polyester fiber fabric, said bottom fabric substrate having a first side which is polymer-coated and a second side, and wherein the polymer-coated side panels are each constructed of a side fabric substrate which is woven polyester fiber fabric having an inner surface and an outer surface, with a polymer coating applied to said inner and outer surfaces.

20. An improved collapsible canoe having a frame covered by a composite skin, the frame having, a pair of gunwales, a series of ribs, each rib being connected at each end to one of the gunwales, a series of longitudinal stringers which are supported by the ribs, and thwarts which stabilize the gunwales, the composite skin having, a bottom panel of a polymer-coated fabric, a pair of polymer-coated side panels attached to the bottom panel, and a pair of gunwale sleeves, each attached to one of the side panels, the gunwale sleeves engaging the gunwales of the frame, the improvement wherein the bottom panel comprises:

a bottom fabric substrate having a first side and a second side;

a bottom polymer coating on said first side of said bottom fabric substrate; and at least one rub strip, said at least one rub strip being provided by a strip of polymer film bonded to the bottom panel so as to be positioned on an area of said polymercoated first side which covers a corresponding at least one of the stringers of the frame.

* * * * *